United States Patent [19]

Mol

[11] 4,174,830

[45] Nov. 20, 1979

[54] SHEET FEEDER FOR A COLLATOR

[75] Inventor: Hans C. Mol, Wilton, Conn.

[73] Assignee: Pitney Bowes, Inc., Stamford, Conn.

[21] Appl. No.: 914,340

[22] Filed: Jun. 12, 1978

[51] Int. Cl.[2] ..... B65H 39/055

[52] U.S. Cl. ..... 270/58

[58] Field of Search ..... 270/58; 271/42, 128–130

[56] References Cited

U.S. PATENT DOCUMENTS

| | | | |
|---|---|---|---|
| 2,624,571 | 1/1953 | Dixon | 270/58 |
| 3,773,313 | 11/1973 | Bassett | 270/58 |

*Primary Examiner*—Edgar S. Burr
*Assistant Examiner*—A. Heinz
*Attorney, Agent, or Firm*—Robert E. Meyer; William D. Soltow, Jr.; Albert W. Scribner

[57] ABSTRACT

In a collator which assembles sheets, the sheets are pushed upwardly by individual sheet pusher arms from each of a group of generally vertically oriented sheet storage bins to a generally horizontal conveyor system which then pulls up and conveys the sheets from the bins to a discharge station. The sheets from the respective bins are fed into the conveyor system at the same time by the sheet pusher arms which are reciprocally driven by a cam actuated bar. The sheet pusher arms are magnetically latched against a member at the top of their upward feeding stroke. This latching is accomplished by an extension of the rear wall of the bin which is angled so as to force the sheet pusher arm back against the magnetic latch member. The sheet pusher arms remain in this latched position out of engagement with the pack of sheets in the sheet storage bins during their downward stroke. At the bottom of their stroke, a pin carried on the sheet pusher arms engages a cam and mechanically breaks the magnetic latch and allows the sheet pusher arm to again engage the sheets in the bin for the next upward stroke. The individual unlatching cams are mounted on a push-pull rod to enable the cams to be retracted from an operating position thereby permitting the sheet pusher arms to remain latched and effectively disabling the sheet feed in individual bins.

3 Claims, 6 Drawing Figures

SHEET FEEDER FOR A COLLATOR

BACKGROUND OF THE INVENTION

The present invention relates generally to an improvement in a sheet collator of the type wherein a plurality of sheet storage bins are provided for storing stacks of sheets. In each of these bins, a sheet feeding means is provided to feed individual sheets from each of the bins to a conveyor located adjacent the open end of the bins. The conveyor then delivers the sheets fed from the bins to a discharge station of the collator wherein the desired collation of the individual sheets is completed. A number of sheet feeding devices have been used in such collating apparatus to feed individual sheets from each of the bins. One well known method for feeding the sheets from the bins has been the use of sheet pusher arms which are simultaneously reciprocated in each of the bins to push the top most sheet of the stack in the bins into engagement with the conveyor system.

These sheet pusher arms have taken a number of different configurations all in an effort to improve the sheet feeding capabilities of the collator. These sheet pusher arms generally have a sheet engaging portion at their end which consists of a flat pad or a roller or some other device which physically engages the top most sheet in the bin. When the pusher arms reciprocate, a sheet will be fed out of the bin when the pusher arm is traveling in one direction but it is desired that there be no action between the end of the sheet pusher arm and the sheets in the bin when the sheet pusher arm is traveling in its other direction. To provide this movement, it has been common to use specially shaped pads or rollers having one-way clutches in rollers at the end of the pusher arm to provide this required action.

The specially shaped pads required carefully selected material because the coefficient of friction between the paper and the pad must be closely controlled. In addition, the shape of the pad required close control and often times wear of the pad would change both its shape and its coefficient of friction, thereby introducing sheet feeding problems to the operation of the machine. Likewise, the use of one-way clutches or other specially shaped rollers again proved to have drawbacks due to the operation of small critical parts and the effect of paper dust on the small components of the rollers. One such sheet pusher is shown in U.S. Pat. No. 4,026,538 to Brown et al and which is also assigned to the same assignee of the present invention.

In addition, it was sometimes desired to run a collator with only a portion of the bins being used to feed sheets. For instance, where a ten-page booklet was being collated and a twenty-bin machine was being used, ten of the bins would not be needed in this operation. In the bins that were not being used, the sheet pusher arms would still be reciprocally driven against the bottom of the bin thereby introducing further wear to the sheet engaging components which had been selected to operate on the paper sheets and not on the structure of the bins. Electrical solenoids have been used in some instances to activate and/or deactivate sheet pursher arms not in use. However, such a system of solenoids involves complex linkages and additional electrical components and controls which increases the cost and may hamper the reliability of the machine. Thus many collators would not permit adjustment to deactivate the sheet pusher arms of sheet storage bins not in use and those that do present a number of drawbacks.

SUMMARY OF THE INVENTION

The present invention obviates the foregoing disadvantage of the prior art collators by providing a relatively simple yet reliable low cost collator to assemble sheets in predetermined order from a plurality of storage bins into an associated group and conveys said assembled sheets to a discharge station. According to the embodiment of the present invention, there is provided a collator having a plurality of open ended sheet storage bins from which sheets are pushed by sheet pusher arms into a conveyor system. Sheet pusher arms are located in each bin and are simultaneously reciprocated by a suitable drive means and are normally engaged with the top most sheet in each storage bin. A conveyor means is provided adjacent the open ends of said bins for receiving sheets from the pusher arms and conveying said sheets to a discharge station located at one end of the collator. A significant aspect of the present invention is the means for controlling the engagement of the sheet pusher arms with the top most sheet of each of the stacks of sheets in the bins. This means includes means for disengaging the sheet pusher arms from the top most sheet when the sheet pusher arm is adjacent the end of its sheet feeding stroke and holding the sheet pusher arm in this position during its retracting stroke and means for re-engaging the sheet pusher arm with the next succeeding top most sheet when the sheet pusher arm is adjacent the end of its retracting stroke.

In this embodiment of the present invention the sheet pusher arms are magnetically latched at the top of their stroke and unlatched by an actuating cam at the bottom of their stroke to deliver individual sheets to the conveyor system. On the downward movement of the sheet pusher arm reciprocation stroke, the sheet pusher arm is latched away from the stack of sheets in each bin. Another feature of the present invention is the unlatching of the magnetically latched sheet pusher arm by a cam slidably mounted by the preceding sheet storage bin to be positioned in and out of the path of a cam pin carried by each sheet pusher arm. An actuating cam carried by a push-pull rod actuates a cam pin carried by the sheet pusher arm to unlatch the sheet pusher arm at the bottom of its downward stroke.

A further feature of this invention is the provision of the operator being able to de-activate any of the sheet storage bins not being used if the number of stacks being collated is less in number than the number of sheet storage bins. A cam actuates a cam pin carried by a sheet pusher arm to magnetically unlatch the sheet pusher at the bottom of its reciprocation stroke. If the cam has been pulled out of the path of the cam pin by a push-pull rod mounted on the back of each preceding bin, the sheet pusher arm remains magnetically latched and continues to travel with all other sheet pusher arms in a latched position until the cam is moved back into position to actuate the cam pin of the sheet pusher thereby resulting in magnetic unlatching of the sheet pusher arm. The sheet pusher arm, when unlatched, falls against the top most sheet of the respective stack of sheets through gravity.

Having briefly described the embodiment of the present invention, is a principal object thereof to provide a new and improved low cost automatic collator. Another object of the invention is to provide a sheet pusher arm for feeding sheets in a collator which engages these sheets only in a sheet feeding direction and is disengaged in a non-feeding direction.

Another object is the provision of cam actuating structure internal to each sheet storage bin to disable and de-activate any or all of the sheet pusher arms from pushing sheets from a bin or riding against the bottom of an empty sheet storage bin. This operation is easily performed by pulling out push-pull rods slidably mounted on the front of the collator.

The invention claimed herein has been described but not claimed in co-pending applications Ser. Nos. 790,348 filed Apr. 25, 1977 now U.S. Pat. No. 4,146,215 and 868,647 filed Jan. 11, 1978 both of which are assigned to the same assignee as the present invention.

BRIEF DESCRIPTION OF THE DRAWINGS

These and other objects and advantages of this invention will be readily appreciated and better understood by reference to the following detailed description when considered in connection with the accompanying drawings where.

DESCRIPTION OF THE PREFERRED EMBODIMENT

Figure 1:
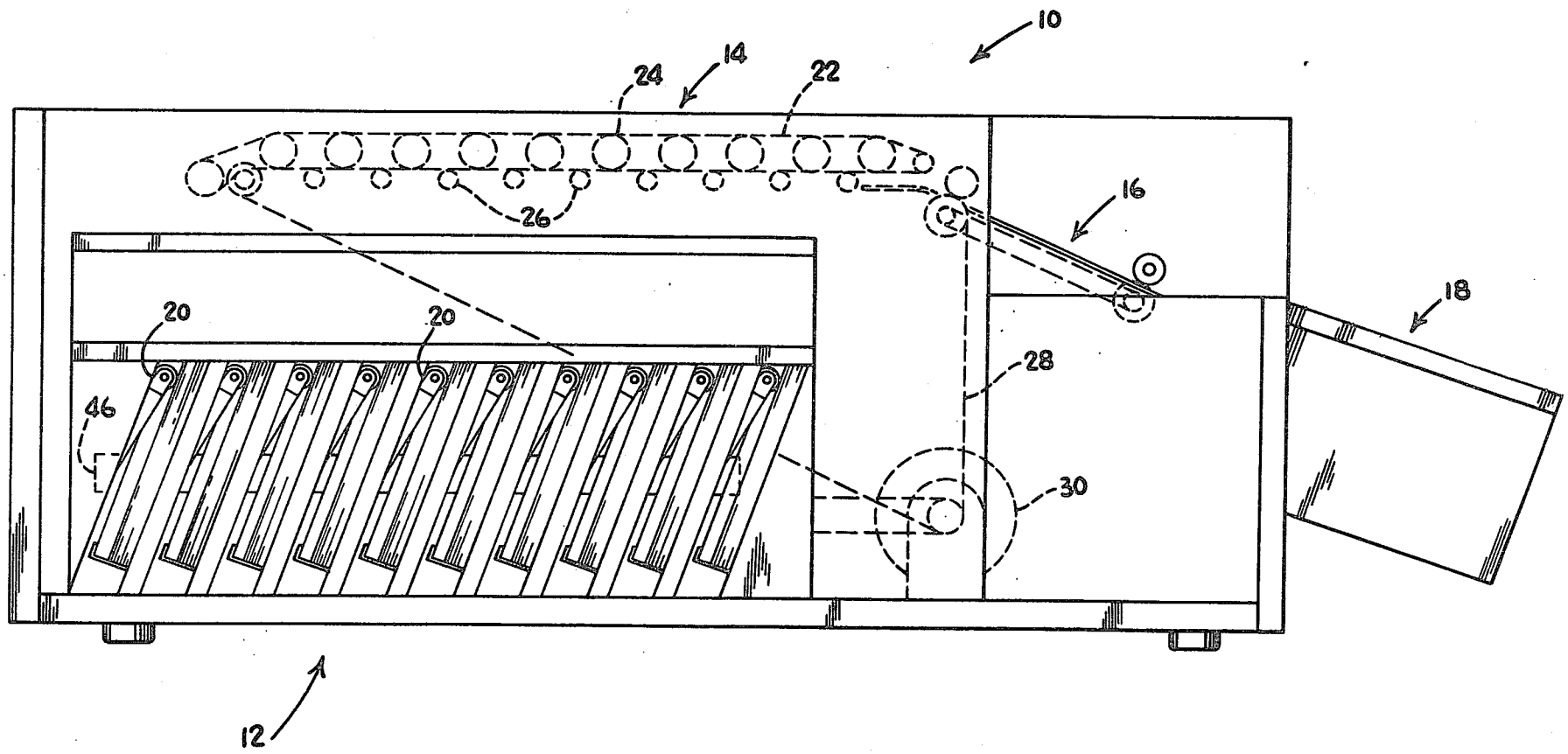
FIG. 1 is a front view of the collator of the present invention.

Now referring to FIG. 1, a collating machine is generally shown as 10. The machine 10 is comprised of an array of ten vertically oriented sheet storage bins 12 affixed to the base of the collator 10. Disposed above the bins 12 is a horizontally oriented conveyor system 14. To the right of the bins 12 is an assembly station 16 which accepts material from the conveyor system 14, aligns and delivers it to a discharge station 18. In operation, single sheets from each of the bins 12 are simultaneously moved upwardly by individual sheet pusher arms 20 located in each of the bins 12 and which will be later described in detail. As the sheets move upward, they come under the control of the conveyor system 14 which transports the sheets in an overlapping manner to the assembly station 16 where the sheets are aligned and then delivered to the discharge station 18. The assembly station 16 may include stapling or other apparatus for fastening the set of sheets together.

The conveyor system 14 consists of a belt 22 supported around a plurality of rollers 24. Cooperating with the lower run of belt 22 is a series of rollers 26. The rollers 26 and the lower run of belt 22 define a sheet passageway for the sheets being ejected from the bins 12. The rollers 26 are each driven by a common chain or belt 28 which is in turn driven by a motor 30. The conveyor belt 22 is effectively driven by its engagement with the plurality of driven rollers 26. The conveyor, rollers, motor, etc. are all supported on a frame in the collator in a manner familiar to those skilled in the art.

Below the conveyor 14 is disposed an array of sheet storage bins 12. Although ten bins are shown, any reasonable or suitable number consistent with the overall use, objects or design capacity may be used. Each of the bins 12 and the associated sheet pusher arms 20 are substantially identical and therefore only one typical bin 12 and pusher arm 20 will be described with reference to FIGS. 2–5. Each bin comprises a rear wall 32 against which a quantity of sheets 34 rest, an end stop 36, and a forward wall 38. The rear wall 32 has an angled portion 40 at the upper end thereof. The purpose of this angled portion will become more apparent with the following discussion of the operation of the pusher arms 20.

Figure 3:
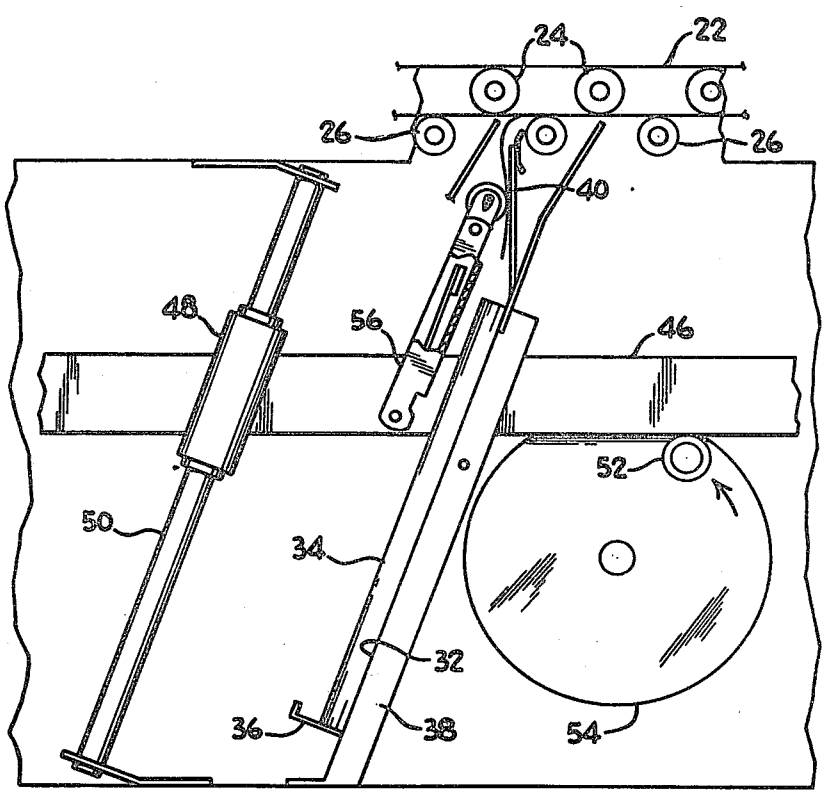
FIG. 3 is a side view similar to FIG. 2 with the sheet pusher arm near the top of its upward stroke.
Figure 2:
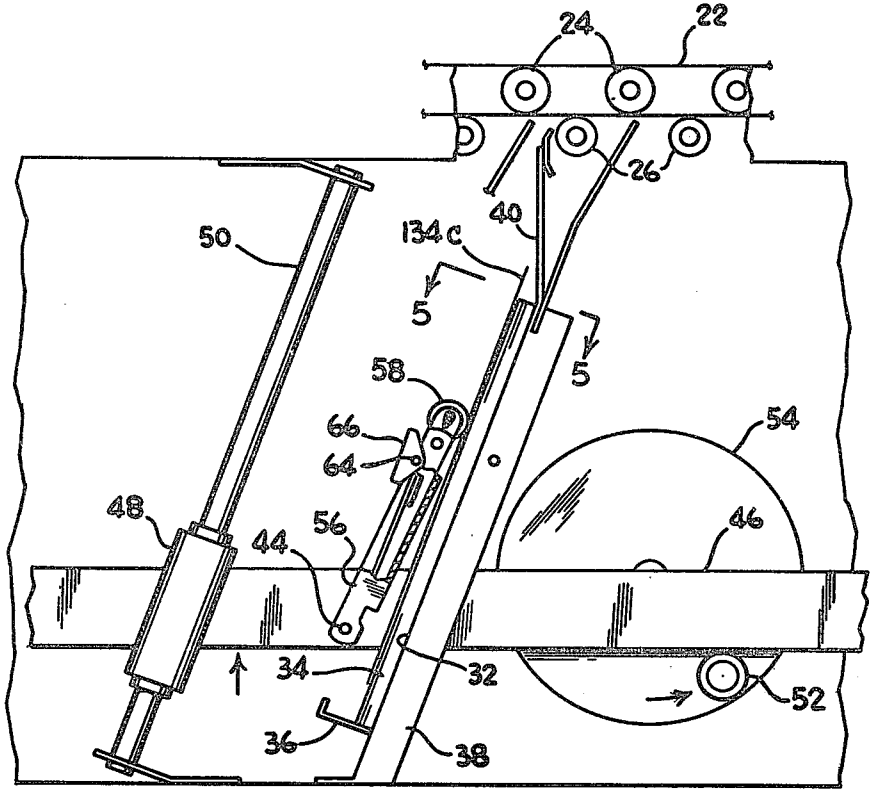
FIG. 2 is a side view of one of the plurality of sheet storage bins and sheet pusher arm mechanisms of the collator of FIG. 1 with the sheet pusher arm beginning its upward stroke.

Each of the pusher arms 20 are connected to a shaft 44 which protrudes from a rear mounted rail 46. The rail 46 extends the length of the collator and is mounted at each end for reciprocating motion in a vertical direction by means of suitable bearings 48 mounted on generally vertically oriented guide shafts 50 one of which is shown in FIGS. 2 and 3. The rail 46 is reciprocally driven by a roller 52 which contacts the lower surface of rail 46. The roller 52 is radially mounted on a disc 54 which is rotatably driven by an appropriate means connected to motor 30. It can be seen that as the disc 54 is rotated by the motor, the roller 52 will impart a vertical up and down motion to the rail 46 which in turn will impart the same motion to the sheet pusher arms 20. As the sheet pusher arms move upward in the bins 12, a sheet 34 is pushed upward into the conveyor 14. The conveyor then transports the sheets to the assembly station 16 while the sheet pusher arms retract to their original position to begin another sheet feeding cycle.

Each pusher arm 20 comprises an elongated, hollow, U-shaped channel member 56 which is pivotably mounted at its lower end to shaft 44. A friction member 58 is carried at the top of the channel member 56 and will engage the top sheet 34 in the bin 12. A strip 60 is angularly fixed to the shaft 44 and disposed within the channel 56. A magnet 62 is carried on the upper portion of the strip 60. In the sheet engaging position as shown in FIG. 2, there is a gap between the magnet 62 and the U-shaped channel 56 of sufficient distance so that the channel member 56 which is made of iron is not attracted to the magnet 62. As the pusher arm 20 moves upwardly in the bin, the friction member 58 pushes the top sheet from the stack and moves it upwardly into engagement with the conveyor 14. As seen in FIG. 3, as the pusher arm continues to move upwardly, it comes into contact with the angled portion 40 of the rear wall 32 which causes the pusher arm to move backwardly to the left. This motion will cause the gap between the magnet 62 and the channel member 56 to diminish to the point where the magnetic attraction of the magnet causes the channel member 56 to become latched to the magnet 62. After this latching has taken place, the pusher arm reaches the top of its reciprocating stroke and is now ready to begin its downward travel. Thus, the downward stroke of the pusher arm will take place with the channel member magnetically latched to the fixed strip 60 and out of engagement with the remaining sheets 34 in the bin.

At the bottom of its travel, the channel member 56 is unlatched from the magnet 62 to re-engage the stack of sheets 34. A pin 64 is carried on the outside of each channel member 56 and engages a camming block 66. The surface of the camming block 66 is shaped so as to force the pin 64 and therefore the channel member 56 back towards the stack of sheets. This movement breaks the magnetic latch previously established between the magnet 62 and the channel member 56 and the pusher arm will continue to move toward the stack of sheets under the influence of gravity, i.e., the center of gravity of the pusher arm 20 is such that it will fall towards the stack of sheets and restores the pusher arm to a sheet engaging position. The pusher arm is now ready to begin another sheet ejecting cycle.

Figure 5:
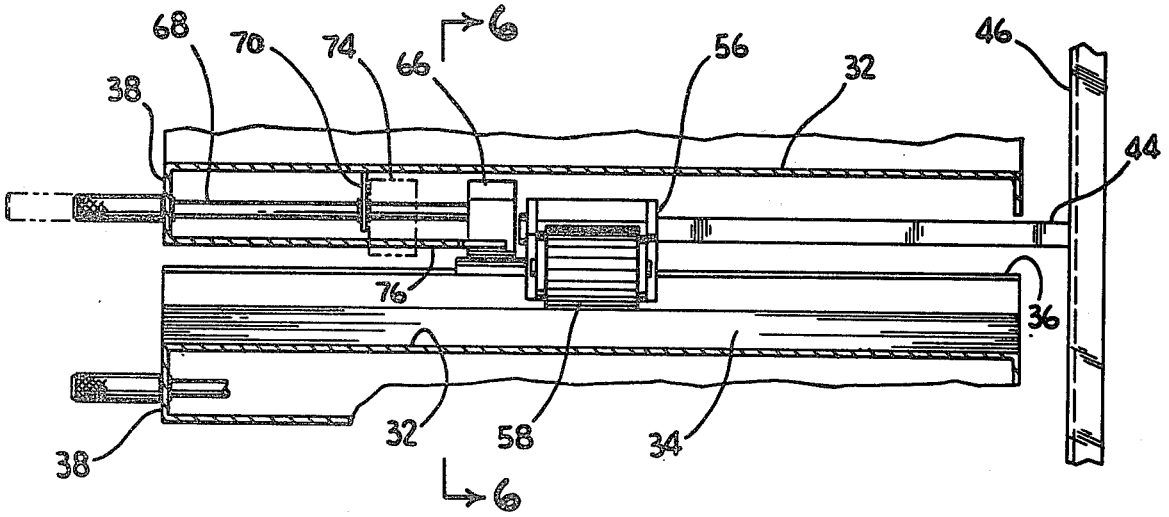
FIG. 5 is a top view of one of the sheet storage bins taken along the lines 5—5 of FIG. 2.

The camming block 66 is mounted on the end of a shaft 68 which is supported by the forward wall 38 of the bin 12 and a lanced out portion 70 of the preceding sheet storage bin 12 as best seen in FIG. 5. The block 66 is shown in a pin 64 engaging position and will thus unlatch the channel member 56 at the bottom of each stroke. However, the shaft 68 may be pulled toward the front of the machine withdrawing the cam block 66 to a position 74 (shown in dotted lines) out of engagement with the pin 64. Thus, the channel member 56 will not be unlatched from the magnet 62 and will remain in a non sheet ejecting position. As long as the camming block 66 remains in this position 74, this condition will prevail even as the pusher arm 20 continues to move up and down in the bin. This condition is desireable, for instance, when the number of sheets being collated is less than the number of bins available in the machine. The sheet pusher arms of the unused bins may be allowed to remain in their latched position and travel up and down in the bin without contacting the bin surface during the upward stroke by simply pulling the appropriate shafts 68 towards the front of the machine.

Figures 4A, 4B, 4C, 4D:
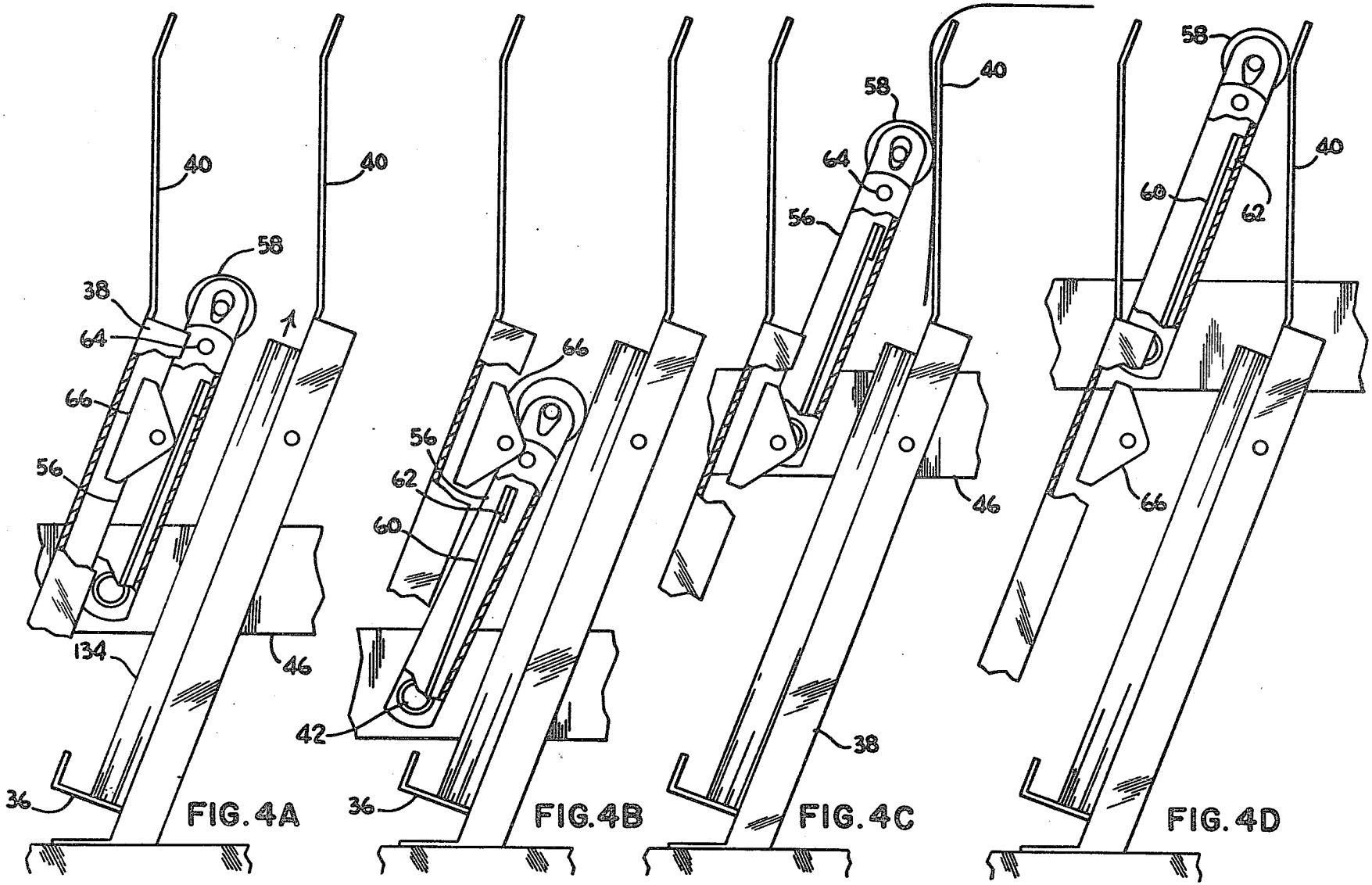
FIGS. 4A–D are a series of partial elevation views showing a sheet feeder moving from its home position (FIG. 4A) along its operative path (FIGS. 4B–D).

FIGS. 4A thru D show a series of positions of the pusher arm during operation of the collator. In the home position (FIG. 4A), the pusher arm 20 is disposed away from the stack of sheets 34 stored in the bin, being held in that position by magnet 62. This allows the bin to be loaded with sheets without interference from the pusher arm. At the start of a collating cycle, rail 46 initially moves a short distance downwardly and pin 64 engages and follows the contour of the upper camming surface of block 66. Accordingly, pusher arm 20 becomes unlatched from magnet 62 as shown in FIG. 4B and falls against the top sheet in the bin. As the collating cycle continues, rail 46 travels upward and carries pusher arm 20 toward overhead conveyor 14 with the friction member 58 pushing the top sheet. Near the top of its stroke (FIG. 4C), the pusher arm 20 has ejected the uppermost sheet 34 into the conveyor 14 and in doing so has advanced onto the angled wall portion 40. In moving up this wall portion 40, the gap between the magnet 62 and channel member 56 is decreased until the magnet attracts and latches the channel member to itself (FIG. 4D). The pusher arm then begins its downward stroke to return to the home position of FIG. 4A with the sheet pusher arm out of contact with the stack of sheets.

Figure 6:
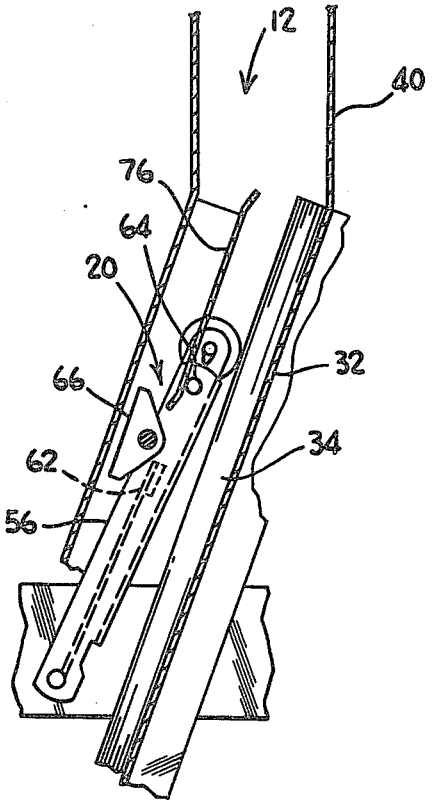
FIG. 6 is another partial side view illustrating the blocking member which prevents premature latching of the sheet pusher arm.

In certain instances, it was found that the sheet pusher arm 20 would become latched to the magnet 62 before a sheet was fed into the conveyor 14 and before the pusher arm reached the angled portion 40 of wall 32. This situation could be caused by placing a large number of loosely packed sheets 34 into a bin 12 thus decreasing the gap between the channel member 56 and the magnet 62. To prevent this premature latching and thereby maintain the sheet pusher arm in engagement with the top most sheet for at least the minimum period of time to effect the feeding of a sheet from the bin 12 to the conveyor 14, a blocking member is placed above the pin 64 to prevent the sheet pusher arm from latching to the magnet 62 during certain portions of the sheet feeding stroke. This blocking member can be formed by a rearward extending portion 76 of the forward wall 38 of each bin (shown in FIGS. 5 and 6). Portion 76 extends over the pin 64 a distance at least equal to the distance from the top of the sheet stack 34 to the conveyor and begins near the bottom of the reciprocating stroke. If the bin contains a large number of loosely packed sheets, the sheet pusher arm is forced back toward the magnet 62. However, before it is latched by the magnet 62, pin 64 will hit against the portion 76 and prevent the pusher arm from latching. This blocking of the latching action will tend to compress the loosely stacked sheets but not enough to affect the feeding action.

Therefore, the sheet pusher arm will remain in engagement with the top most sheet 34 in the bin and feed it from the bin to the conveyor. Once the pin 64 passes by the end of portion 76, the pusher arm may latch itself to the magnet but no ill effects will occur since by this time the sheet is under control of the conveyor 14.

What is claimed is:

1. Sheet collating apparatus comprising:

A. a plurality of parallel spaced open ended sheet storage bins for storing stacks of sheets therein;

B. pusher means movably mounted in each of said bins and normally operatively engaged with the topmost sheet of each of said stacks to push said topmost sheets from said bins;

C. drive means for simultaneously reciprocating said pusher means in each of said bins in a sheet pushing stroke and a retracting stroke;

D. conveyor means disposed adjacent the open ends of said bins for receiving sheets from said pusher means and for conveying said sheets to a discharge station of the collating apparatus, and;

E. means for controlling said normal operative engagement of said pusher means with the topmost sheet of each of said stacks, said means including a magnetic latching plate carried on one portion of said pusher means and a magnet affixed to another portion of said pusher means for disengaging said pusher means from said topmost sheet when said pusher means is adjacent the end of its sheet pushing stroke whereat said magnet pulls in and latches said pusher means to said magnetic latching plate and means for re-engaging said pusher means with the next succeeding topmost sheet when said pusher means is adjacent the end of its retracting stroke whereby said pusher means is out of engagement with said succeeding topmost sheet during the retracting stroke of said pusher means.

2. The collator of claim 1 wherein said sheet re-engaging means includes a cam and said pusher means includes a cam follower whereby said cam follower rides over said cam breaking the magnetic latch causing said pusher means to fall against said topmost sheet when said pusher means is adjacent the end of its retracting stroke.

3. The collator of claim 2 further comprising a disabling member affixed to said cam and being operable to move said cam into or out of the path of travel of said cam follower whereby the means for re-engaging said succeeding topmost sheet is disabled and said sheet pusher remains in a latched condition.

* * * * *

UNITED STATES PATENT AND TRADEMARK OFFICE

CERTIFICATE OF CORRECTION

PATENT NO. : 4,174,830

DATED : November 20, 1979

INVENTOR(S) : Hans C. Mol

It is certified that error appears in the above—identified patent and that said Letters Patent is hereby corrected as shown below:

Column 1, line 63, change "pursher" to -- pusher --.

Column 5, line 25, change "desireable" to -- desirable --.

Signed and Sealed this

*Third* Day of *November 1981*

[SEAL]

*Attest:*

GERALD J. MOSSINGHOFF

*Attesting Officer*

*Commissioner of Patents and Trademarks*